US007533881B2

(12) United States Patent
Yoshida

(10) Patent No.: US 7,533,881 B2
(45) **Date of Patent: *May 19, 2009**

(54) SHEET FEEDING DEVICE AND IMAGE FORMING DEVICE WITH LINKED ROTATABLE GUIDE MEMBERS

(75) Inventor: Kazuhiko Yoshida, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 121 days.

This patent is subject to a terminal disclaimer.

(21) Appl. No.: 11/262,892

(22) Filed: Nov. 1, 2005

(65) Prior Publication Data

US 2007/0007715 A1 Jan. 11, 2007

(30) Foreign Application Priority Data

Jun. 22, 2005 (JP) ..... 2005-182410

(51) Int. Cl.
*B65H 29/00* (2006.01)

(52) U.S. Cl. ..... 271/186; 271/4.1; 271/65; 271/301; 271/127; 271/10.11; 399/401; 399/364

(58) Field of Classification Search ..... 271/4.1, 271/4.01, 4.08, 65, 186, 301, 126, 127, 225, 271/10.01, 10.09, 10.11, 3.18, 3.19; 399/401, 399/364

See application file for complete search history.

(56) References Cited

U.S. PATENT DOCUMENTS 4,113,244 A * 9/1978 Ruenzi ..... 271/4.1
4,131,273 A * 12/1978 Kufrin et al. ..... 271/4.08
4,186,662 A * 2/1980 Borneman ..... 101/218
4,456,238 A * 6/1984 Mizuma ..... 271/3.02
4,660,963 A * 4/1987 Stemmle ..... 355/24
5,465,950 A * 11/1995 Takemoto et al. ..... 271/125
5,839,032 A * 11/1998 Yasui et al. ..... 399/124
6,128,463 A * 10/2000 Matsumoto et al. ..... 399/364
6,185,380 B1 * 2/2001 Abe et al. ..... 399/18
6,862,428 B2 * 3/2005 Sasaki ..... 399/401
2006/0285904 A1 12/2006 Yoshida

FOREIGN PATENT DOCUMENTS

JP 2004-85632 A 3/2004
JP 2004085632 A * 3/2004

* cited by examiner

*Primary Examiner*—Patrick H Mackey
*Assistant Examiner*—Gerald W McClain
(74) *Attorney, Agent, or Firm*—Sughrue Mion, PLLC

(57) ABSTRACT

A sheet feeding device including: a sheet feeding roller for sending sheets out one-by-one; a sheet stacking section in which a plurality of sheets can be stacked, and which pushes a sheet against the sheet feeding roller; an upper guide member able to move between a guiding position at which, at a time of double-sided printing, the upper guide member re-feeds to the image forming section an inverted sheet which is sent-in by a sheet re-feeding section, and a withdrawn position, at which sheet feeding of the sheet stacking section is possible; and a lower guide member which is rotatable and which abuts leading ends of sheets stacked in the sheet stacking section, wherein a guide path, which guides a sheet which is re-fed at the time of double-sided printing, is formed due to the upper guide member and the lower guide member rotating interlockingly.

18 Claims, 7 Drawing Sheets

SHEET FEEDING DEVICE AND IMAGE FORMING DEVICE WITH LINKED ROTATABLE GUIDE MEMBERS

CROSS-REFERENCE TO RELATED APPLICATION

This application claims priority under 35 USC 119 from Japanese Patent Application No. 2005-182410, the disclosure of which is incorporated by reference herein.

BACKGROUND OF THE INVENTION

1. Field of the Invention

The present invention relates to a sheet feeding device at which a sheet conveying path can be switched when a sheet stacked in a sheet feed tray is sent-out, and when, at the time of double-sided printing, a sheet which is being conveyed along a sheet re-conveying path is again fed to an image forming section, and relates to an image forming device equipped with the sheet feeding device.

2. Description of the Related Art

Conventionally, a sheet feeding roller, which sends-out one-by-one sheets which are stacked in a sheet feed tray, is disposed in an image forming device such as a copier, a printer or the like. The sheet which is fed-out by the sheet feeding roller is conveyed through a conveying path to an image forming section, and an image is formed on the surface of the sheet. Further, a sheet re-feeding path, which is for, at the time when double-sided printing is to be carried out on the sheet, inverting the sheet which has passed through the image forming section once and re-feeding the sheet to the image forming section, is disposed in the image forming device.

In such an image forming device, at the time of sheet feeding, the sheets which are stacked in the sheet feed tray are sent-out one-by-one and conveyed to the image forming section. At the time of double-sided printing, the sheet conveying path must be switched such that the sheet is re-conveyed by the sheet re-feeding path and is fed again to the image forming section.

As a means therefor, for example, a re-feeding guide member is provided between the sheets stacked in the sheet feed tray and the sheet feeding roller. The re-feeding guide member is for re-feeding, to the image forming section, the sheet which is conveyed-in from the sheet re-feeding path. At the time of double-sided printing, the re-feeding guide member is disposed along the peripheral direction of the sheet feeding roller, and guides the sheet, which is conveyed along the sheet re-feeding path, to the image forming section. At the time of ordinary sheet feeding, the re-feeding guide member is rotated by a motor to the upstream side, in the sheet feeding direction, of the sheet feeding roller, and is withdrawn from the sheet conveying path. In this way, when a sheet within the sheet feed tray is sent-out by the sheet feeding roller, the re-feeding guide member does not interfere with the sheet. (Refer to, for example, Japanese Patent Application Laid-Open (JP-A) No. 2004-85632.)

However, in the sheet feeding device disclosed in JP-A 2004-85632, when a sheet is to be sent-out from the sheet feed tray, there is the need for space for rotating the re-feeding guide member to the sheet feeding direction upstream side of the sheet feeding roller, and the need for a driving section such as a motor or the like for rotating the sheet re-feeding guide member. Therefore, the device becomes large, and costs increase.

SUMMARY OF THE INVENTION

The present invention was made in view of the aforementioned, and is to provide a sheet feeding device and an image forming device in which the switching of a sheet conveying path, at the time of feeding of a sheet and at the time of double-sided printing of a sheet, can be realized without a rise in costs and in a more compact space.

A first aspect of the present invention is a sheet feeding device for feeding a sheet to an image forming section, the device including: a sheet feeding roller for sending sheets out one-by-one; a sheet stacking section in which a plurality of sheets can be stacked, and which pushes a sheet against the sheet feeding roller; an upper guide member able to move between a guiding position at which, at a time of double-sided printing, the upper guide member re-feeds to the image forming section an inverted sheet which is sent-in by a sheet re-feeding section, and a withdrawn position, at which sheet feeding of the sheet stacking section is possible; and a lower guide member which is rotatable and which abuts leading ends of sheets stacked in the sheet stacking section, wherein a guide path, which guides a sheet which is re-fed at the time of double-sided printing, is formed due to the upper guide member and the lower guide member rotating interlockingly.

A second aspect of the present invention is an image forming device including: an image forming section which forms an image on a sheet; a sheet feeding device for feeding a sheet to the image forming section; and a sheet re-feeding section for re-feeding, to the image forming section, a sheet which is inverted after passing through the image forming section, wherein the sheet feeding device has: a sheet feeding roller for sending sheets out one-by-one; a sheet stacking section in which a plurality of sheets can be stacked, and which pushes a sheet against the sheet feeding roller; an upper guide member able to move between a guiding position, at which the upper guide member re-feeds to the image forming section an inverted sheet which is sent-in by the sheet re-feeding section, and a withdrawn position, at which sheet feeding of the sheet stacking section is possible; and a lower guide member which is rotatable and which abuts leading ends of sheets stacked in the sheet stacking section, and a guide path, which guides a sheet which is being re-fed at a time of double-sided printing, is formed due to the upper guide member and the lower guide member rotating interlockingly.

In accordance with the present aspects, the upper guide member rotates between a guiding position at which, at the time of double-sided printing, the upper guide member re-feeds to the image forming section a sheet which is sent-in by the sheet re-feeding section, and a withdrawn position, at which sheet feeding of the sheet stacking section is possible. The lower guide member, which abuts the leading ends of the sheets stacked in the sheet stacking section, is provided so as to be rotatable. Further, the guide path, which guides a sheet which is being re-fed at the time of double-sided printing, is formed due to the upper guide member and the lower guide member rotating interlockingly. Therefore, a sheet, which is sent-in by the sheet re-feeding section at the time of double-sided printing, is guided by the guide path and is re-fed smoothly to the image forming section. Further, at the time of feeding a sheet from the sheet stacking section, the upper guide member is rotated to the withdrawn position, and the sheet is sent-out from the sheet stacking section. In this way, the rotational space of the upper guide member and the lower guide member, which switch between the guide path of the sheet at the time of double-sided printing and the conveying path at the time of feeding from the sheet stacking section, can be made to be small, and compactness of the device is possible. Moreover, if the upper guide member is structured so as to be able to rotate between the sheet feeding roller and the sheets which are stacked in the sheet stacking section, the rotational space of the upper guide member can be made to be even smaller, and compactness of the device is possible.

BRIEF DESCRIPTION OF THE DRAWINGS

An embodiment of the present invention will be described in detail based on the following figures, wherein.

DETAILED DESCRIPTION OF THE INVENTION

Figure 1:
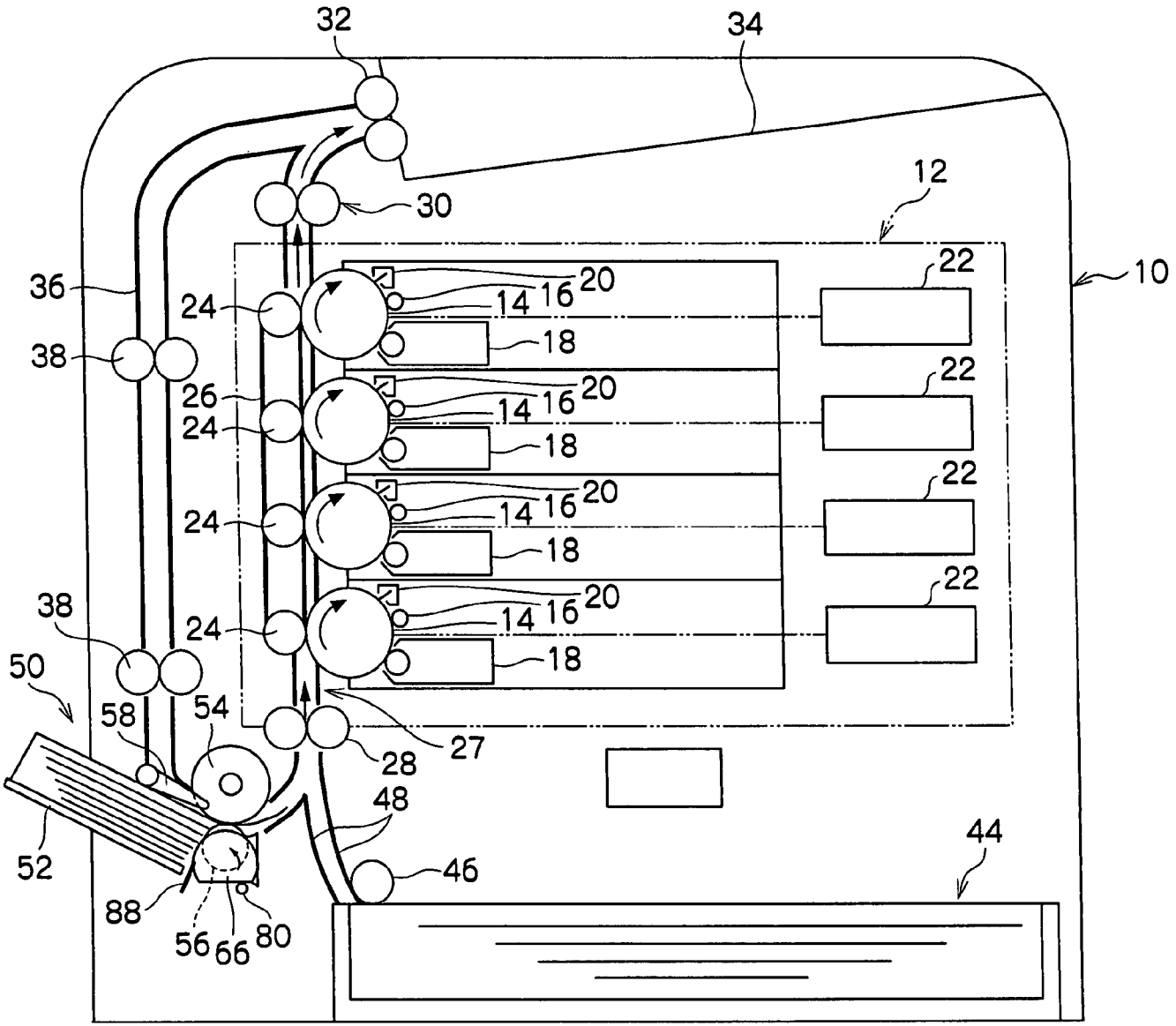
FIG. 1 is a schematic structural view showing an image forming device equipped with a sheet feeding device relating to an embodiment of the present invention.

An image forming device 10 equipped with a sheet feeding device 50 of an embodiment of the present invention is shown in FIG. 1.

The image forming device 10 has an image forming section 12 which forms toner images of the four colors of yellow, magenta, cyan, and black. In the image forming section 12, four photosensitive drum 14 are disposed at substantially uniform intervals in the vertical direction. A charger 16, a developing device 18, and a cleaner 20 are disposed along the circumferential direction at each of the photosensitive drums 14. An image writing device 22, which illuminates laser light onto the surface of the photosensitive drum 14, is provided between the charger 16 and the developing device 18.

Four transfer rollers 24 are provided so as to oppose the photosensitive drums 14, at the sides of the photosensitive drums 14 opposite the sides at which the image writing devices 22 are provided. A conveying belt 26 is trained about the periphery of the four transfer rollers 24, and a sheet P is conveyed along the conveying belt 26. The sheets P, which are paper sheets or the like, are fed one-by-one from the sheet feeding device 50 which will be described later, or from a sheet tray 44. The sheet P is conveyed by a pair of conveying rollers 28 disposed at a conveying path 27, and is conveyed between the respective photosensitive drums 14 and transfer rollers 24.

The surfaces of the photosensitive drums 14 are charged to predetermined potentials by the respective chargers 16. Then, the laser lights from the image writing devices 22 are illuminated such that the surfaces of the photosensitive drums 14 are exposed, and electrostatic latent images are formed thereon. The electrostatic latent images are developed by the developing devices 18 such that yellow, magenta, cyan, and black toner images are formed on the surfaces of the four photosensitive drums 14. Note that the toner, which is not transferred onto the sheet P and remains on the surfaces of the photosensitive drums 14, is recovered by the cleaners 20.

The toner images which are formed on the surfaces of the photosensitive drums 14 are successively transferred, by the operation of the transfer rollers 24 which oppose the photosensitive drums 14, onto the sheet P which is being conveyed along the conveying belt 26, and the toner images of the four colors are superposed one on the other on the sheet P. Thereafter, the toner image on the sheet P is heated and fused at a fixing device 30 which is disposed at the conveying direction downstream side, such that the toner image is fixed on the sheet P. A pair of discharge rollers 32 are provided at the conveying direction downstream side of the fixing device 30. The sheet P is conveyed by the discharge rollers 32, and discharged-out onto a discharge tray 34.

On the other hand, when double-sided printing is to be carried out on the sheet P, after an image is formed on the obverse of the sheet P at the image forming section 12, the discharge rollers 32 are rotated reversely in a state in which the trailing end of the sheet P is nipped by the discharge rollers 32. In this way, the sheet P is inverted, and is conveyed to a re-feeding path 36 for double-sided printing. At the re-feeding path 36, the sheet P is conveyed by plural pairs of conveying rollers 38, and is fed to the conveying rollers 28 of the conveying path 27 via the sheet feeding device 50 which will be described hereinafter. Then, the sheet P is again conveyed to the image forming section 12, and an image is formed on the reverse surface of the sheet P.

Figure 3A:
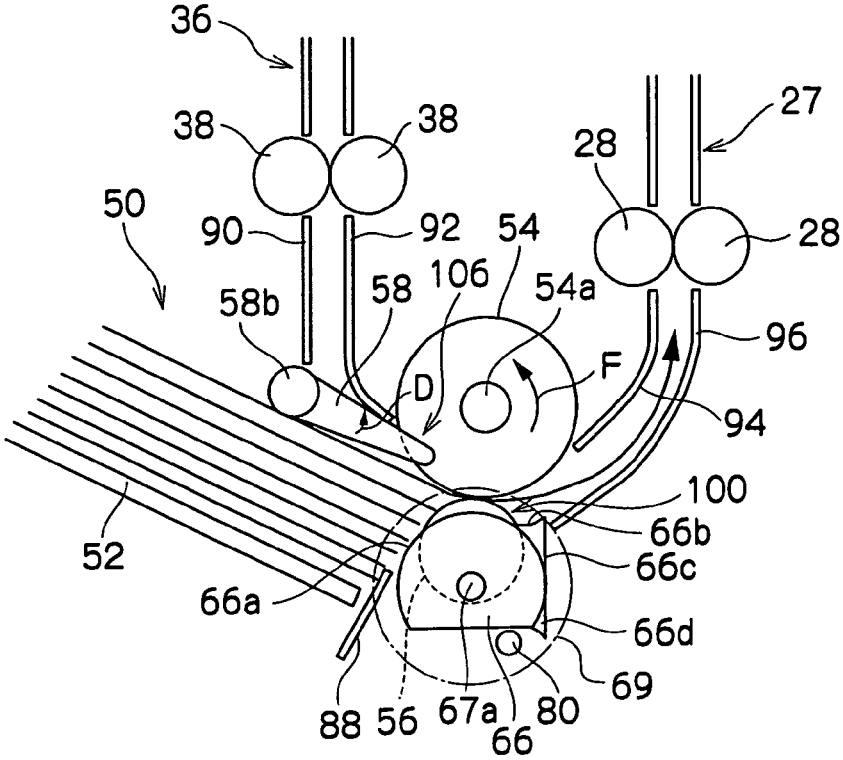
FIG. 3A is a structural diagram showing a state in which the upper guide member and a lower guide member in concert form a sheet feed path at the time of feeding a sheet from a sheet feed tray.
Figure 3B:
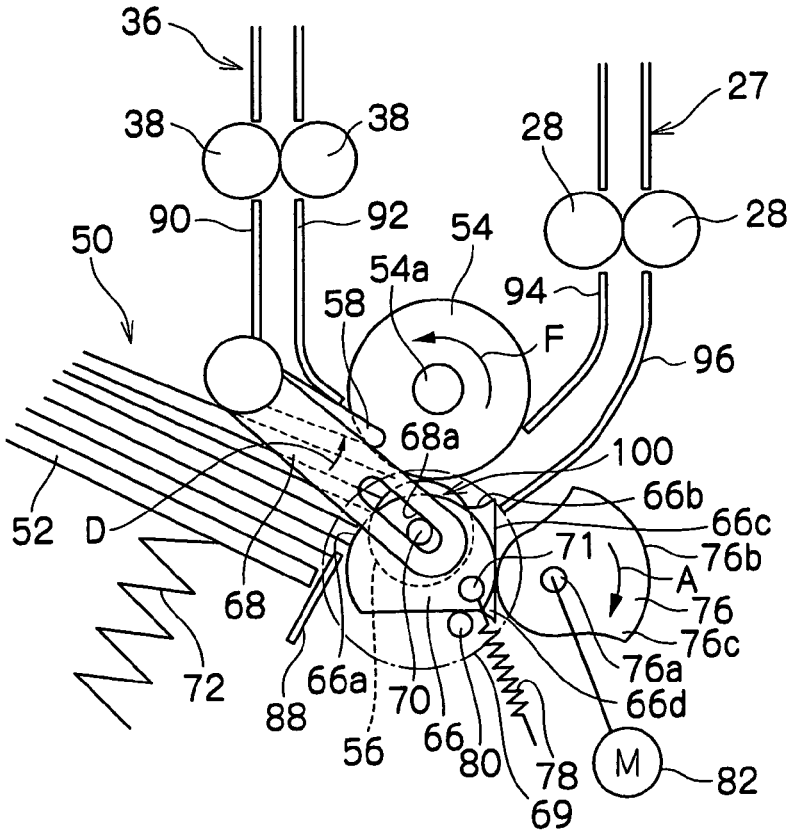
FIG. 3B is a diagram showing a state of a cam which rotates the upper guide member and the lower guide member.

The sheet feeding device 50 is disposed at a side portion at the lower portion of the image forming device 10. As shown in FIGS. 3A and 3B, the sheet feeding device 50 has a sheet feed tray 52 in which the plural sheets P can be stacked. A sheet feeding roller 54 is disposed diagonally above the sheet feeding direction downstream side of the sheet feed tray 52. The sheet feeding roller 54 can rotate in the direction of arrow F around a supporting shaft 54*a*. As shown in FIG. 3B, the sheets P which are stacked within the sheet feed tray 52 are pressed against the sheet feeding roller 54 due to a spring 72 which is provided beneath the sheet feed tray 52. In this way, due to the sheet feeding roller 54 rotating while frictionally contacting the top surface of the sheet P, the uppermost sheet P is sent-out (fed) successively.

Figure 5:
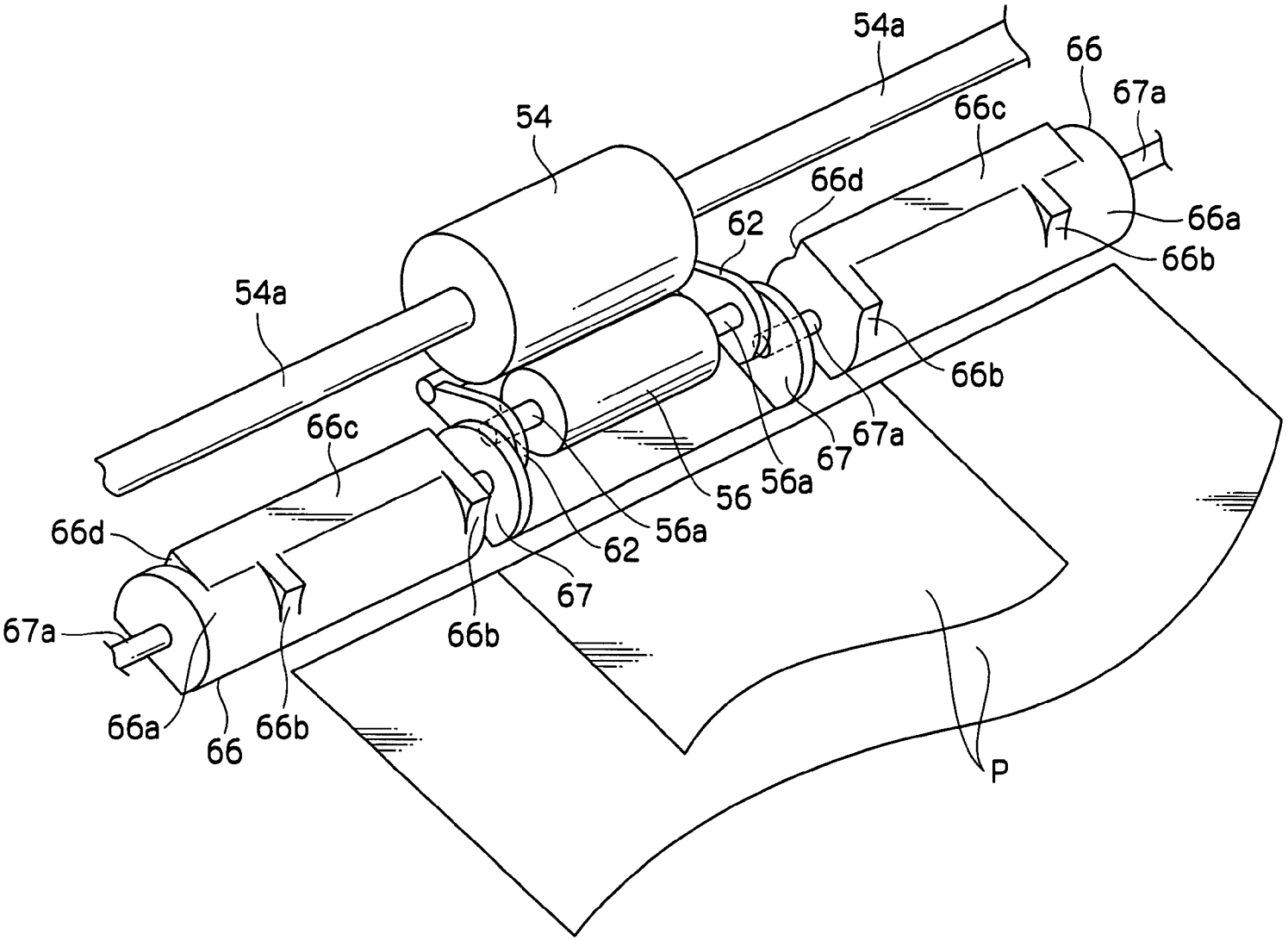
FIG. 5 is a perspective view showing the sheet feeding roller, a separating roller, and the lower guide members.
Figure 6:
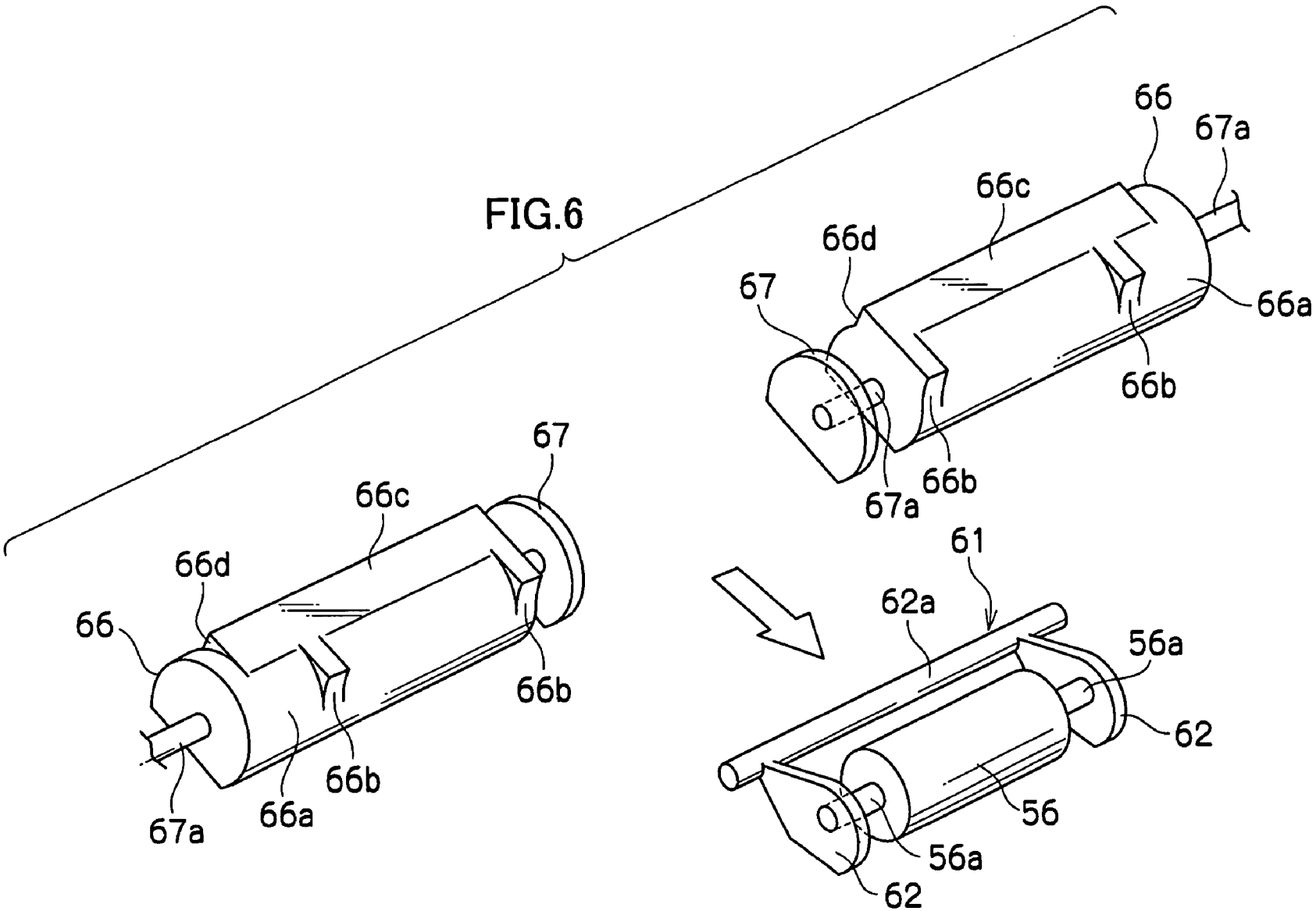
FIG. 6 is an exploded perspective view showing the separating roller and the lower guide members.

A separating roller 56, which press-contacts the sheet feeding roller 54, is disposed beneath the sheet feeding roller 54. The sheets P are separated one-by-one at the nip portion between the sheet feeding roller 54 and the separating roller 56. As shown in FIG. 5, the sheet feeding roller 54 is provided in a vicinity of the substantially central portion in the longitudinal direction (the direction orthogonal to the sheet feeding direction) of the sheet feeding device 50. The separating roller 56 is provided at a substantially central portion in the longitudinal direction, at a position opposing the sheet feeding roller 54. As shown in FIG. 6, a supporting shaft 56*a* of the separating roller 56 is rotatably supported at frames 62 at the both end portions of a holder 61. The holder 61 is supported so as to be rotatable around a supporting shaft 62*a* at an unillustrated housing.

Figure 2:
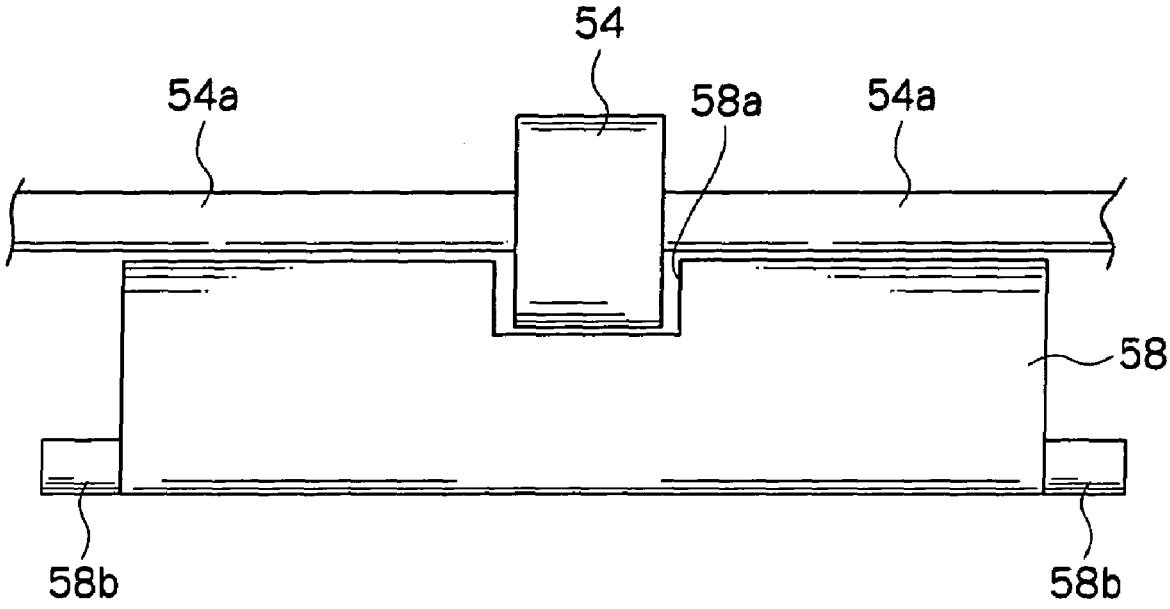
FIG. 2 is a view, as seen from a direction orthogonal to a longitudinal direction, of a sheet feeding roller and an upper guide member of the sheet feeding device shown in FIG. 1.

An upper guide member 58 is provided between the sheet feeding roller 54 and the sheets P stacked in the sheet feed tray 52, at the sheet feeding direction upstream side of the nip portion between the sheet feeding roller 54 and the separating roller 56. As shown in FIG. 2, a cut-out 58*a* is formed in the upper guide member 58 so as to correspond to the outer shape of the sheet feeding roller 54. The distal ends of the both sides of the cut-out 58*a* are positioned at the both sides of the sheet feeding roller 54. The upper guide member 58 is supported so as to be able to rotate around a supporting shaft 58*b* which is at a sheet feeding direction upstream side. The upper guide member 58 can rotate between a guiding position 104 shown in FIG. 4A, at which the upper guide member 58 re-feeds to the image forming section 12 the sheet P which is sent-in from the re-feeding path 36, and a withdrawn position 106 shown in FIGS. 3A and 3B, at which the upper guide member 58 does not project-out from the sheet feeding roller 54 side toward the sheets P of the sheet feed tray 52. The rotating mechanism will be described later. Because the cut-out 58*a* is formed in the upper guide member 58, when the upper guide member 58 is rotated to the withdrawn position 106 as shown in FIG. 3A, the upper guide member 58 does not impede rotation of the sheet feeding roller 54. Further, because the upper guide member 58 rotates around the supporting shaft 58*b* which is at the sheet feeding direction upstream side, the space over which the upper guide member 58 moves can be made to be small.

Figure 7:
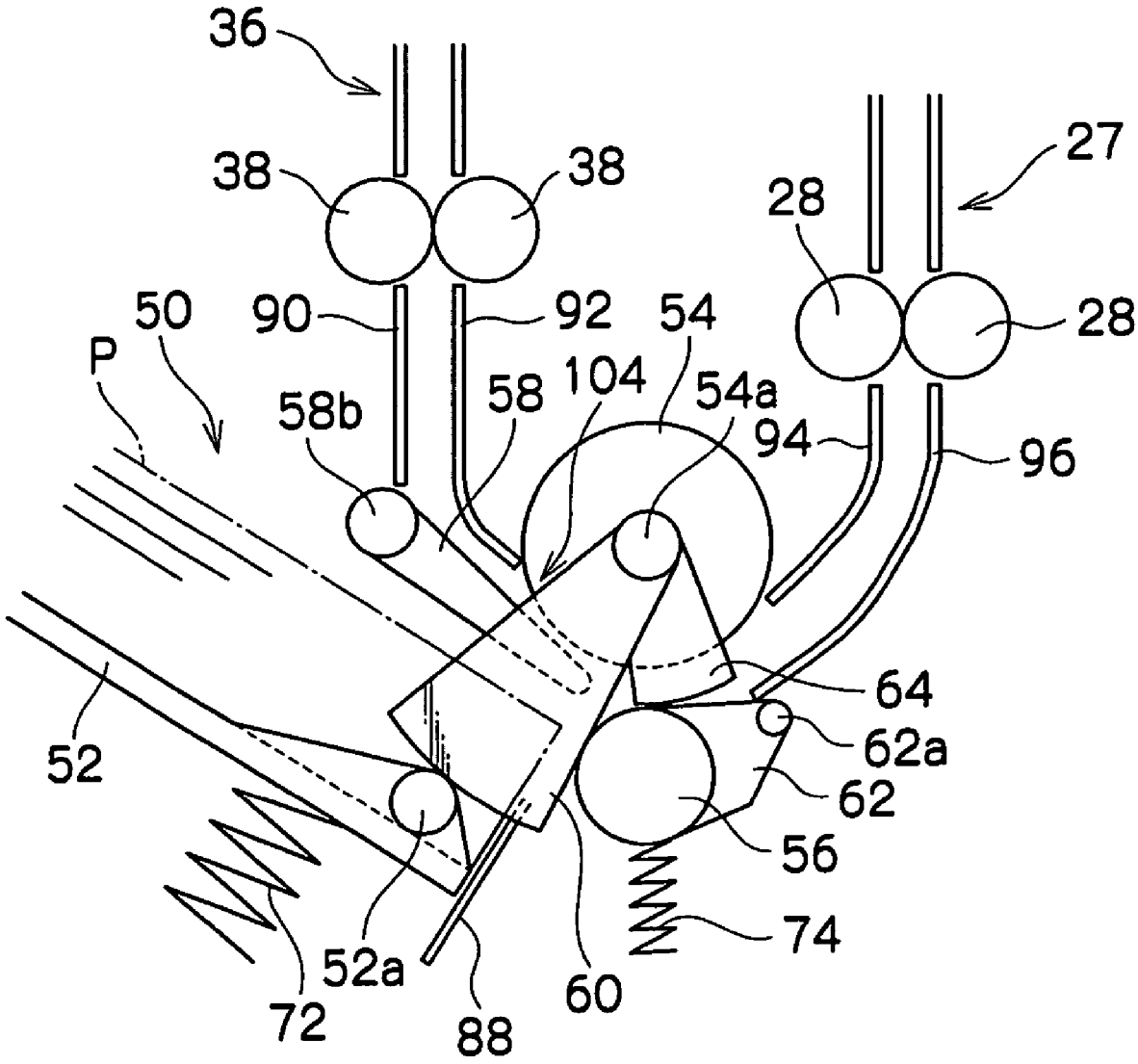
FIG. 7 is a structural diagram showing a state in which, at the time of double-sided printing, the sheet feed tray is moved by first cams, and the separating roller is moved by second cams.

As shown in FIG. 7, first cams 60, which can abut rollers 52*a* which project out at the both end portions of the sheet feed tray 52, are provided at the both sides of the supporting shaft 54*a* of the sheet feeding roller 54. Second cams 64, which can abut the end portions of the frames 62 supporting the separating roller 56, are provided at the inner sides of the first cams 60 of the supporting shaft 54*a*. The first cams 60 and the second cams 64 rotate integrally with the sheet feeding roller 54 due to the rotation of the supporting shaft 54*a*.

The sheet feed tray 52 is structured so as to be able to rise and fall in the vertical direction around a supporting portion (not illustrated) which is at the sheet feeding direction upstream side. The spring 72 is provided beneath the sheet feed tray 52. The sheets P stacked in the sheet feed tray 52 are pushed toward the sheet feeding roller 54 by the force of the spring 72 (see FIG. 3B). The frames 62 are supported so as to be rotatable around the supporting shaft 62*a* which is at the sheet feeding direction downstream side, and springs 74 are provided beneath the frames 62 (see FIG. 7). Due to the forces of the springs 74, the frames 62 are urged in the direction of the sheet feeding roller 54 such that the separating roller 56 press-contacts the sheet feeding roller 54 (see FIG. 3B). Further, a guide plate 88, which restricts the leading end surfaces of the lower portion of the stacked sheets P, is disposed at the sheet feeding direction downstream side of the sheet feed tray 52 (see FIG. 7).

As shown in FIGS. 3A and 5, lower guide members 66 are disposed at both sides of the separating roller 56. Supporting shafts 67*a*, which are formed at the both end portions of the lower guide members 66, are rotatably supported at frames 67. The frames 67 are provided at the both sides of the lower guide members 66, and are held at an unillustrated housing. As shown in FIG. 6, the holder 61 of the separating roller 56 is disposed at the inner sides of the frames 67 of the two lower guide members 66. Note that a circle 69, which is concentric with the supporting shafts 67*a* in FIGS. 3A and 3B, conveniently shows for convenience the rotation locus of the maximum radius of the lower guide members 66.

As shown in FIGS. 3A and 5, the lower guide member 66 has a peripheral surface portion 66*a* formed from an arc-shaped surface whose curvature is greater than that of the separating roller 56. The cross-sectional configuration of the peripheral surface portion 66*a* occupies about ⅔ of a circle. The lower guide member 66 is configured such that, when the peripheral surface portions 66*a* are rotated to a position opposing the sheet feeding roller 54, the peripheral surface portions 66*a* are positioned lower than the peripheral surface of the separating roller 56. Above the guide plate 88, the peripheral surface portions 66*a* abut the sheet feeding direction leading ends of the sheets P stacked in the sheet feed tray 52, and restrict the leading ends of the sheets P.

The lower guide member 66 has projections 66*b* which project while curving toward the sheet feeding direction downstream side of the peripheral surface portion 66*a*. The curved surfaces of the projections 66*b* push and return the sheets P toward the sheet feed tray 52. As shown in FIG. 5, a total of four of the projections 66*b* are provided, with one projection 66*b* provided at each of the both sides of the separating roller 56 in order to abut the sheet P of the minimum width, and projections 66*b* provided slightly inwardly of the maximum width in order to abut the sheet P of the maximum width. Note that the number of the projections 66*b* is not limited to four.

Further, as shown in FIGS. 3A and 5, a guide surface 66*c*, which is planar and is positioned on a tangent line from the distal ends of the projections 66*b* to the peripheral surface portion 66*a*, is formed at the lower guide member 66 at the sheet feeding direction downstream sides of the projections 66*b*. A protruding portion 66*d*, which protrudes while curving from a surface substantially orthogonal to the guide surface 66*c*, is formed at the rear of the guide surface 66*c* of the lower guide member 66.

As shown in FIG. 3B, link members 68 are mounted, at a predetermined angle with respect to the upper guide member 58, at the both end portions of the supporting shaft 58*a* of the upper guide member 58. A hole 68*a* shaped as an elongated circle is formed in the distal end of the link member 68. Engaging pieces 70, which are cylindrical and project out toward the both end sides from the side surfaces of the lower guide members 66, engage with the holes 68*a*.

Cams 76, which rotate the lower guide members 66, are disposed at the sheet feeding direction downstream side of the lower guide members 66. The cam 76 is supported so as to be able to rotate around a shaft portion 76*a*. The cam 76 is substantially fan-shaped. A peripheral surface portion 76*b*, which is concentric with the shaft portion 76*a*, is formed at the distal end of the fan shape. The root portion of the fan shape of the cam 76 is a round peripheral surface which is smaller than the peripheral surface portion 76*b*. Curved surfaces are formed from this round peripheral surface to the peripheral surface portion 76*b*, and the edge portions thereof with the peripheral surface portion 76*b* are pointed portions 76*c* which project out.

A spring 78 is disposed beneath the lower guide member 66. One end of the spring 78 is anchored on an anchor portion 71 which is formed in a vicinity of the protruding portion 66*d* of the lower guide member 66. The other end of the spring 78 is anchored on a lower fixed frame which is not shown. A motor 82 is connected to the cam 76, and the driving force from the motor 82 is transferred to the cam 76 such that the cam 76 rotates in the direction of arrow A. At this time, the sheet feeding roller 54 and the cams 76 can be driven by separate motors. However, by causing gears (not shown), which are provided coaxially with the supporting shaft 54*a* of the sheet feeding roller 54, and gears (not shown), which are provided at the shaft portions 76*a* of the cams 76, to mesh together, the sheet feeding roller 54 and the cams 76 can be rotated by the one motor 82. In this way, there is no need for a driving section such as a motor or the like to be used exclusively for rotating the cams 76, and costs can be reduced. Further, a stopper 80, which restricts rotation of the lower guide member 66 in the sheet feeding direction, is disposed beneath the lower guide member 66.

Further, guide plates 90, 92 are disposed so as to oppose one another with the re-feeding path 36 therebetween, at the lower portion of the re-feeding path 36. The guide plates 90, 92 guide the sheet P, which is sent-in along the re-feeding path 36 at the time of double-sided printing, between the upper guide member 58 and the sheet feeding roller 54. Further, guide plates 94, 96, which guide the sheet P to the conveying rollers 28, are disposed so as to oppose one another with the conveying path 27 of the sheet P therebetween, at the downstream side of the portion where the lower guide members 66 and the sheet feeding roller 54 oppose one another.

As shown in FIG. 1, the sheet tray 44 is disposed at the lower portion of the image forming device 10. Sheets P of different sizes than the sheet feed tray 52 can be stacked within the sheet tray 44. A sheet feeding roller 46, which sends the stacked sheets P out one-by-one, is disposed at the sheet feeding direction downstream side of the sheet tray 44. Further, guide plates 48, which guide the sheet P to the conveying rollers 28, are disposed at the downstream side of the sheet feeding roller 46 so as to oppose one another with the conveying path of the sheet P therebetween.

Next, operation of the sheet feeding device 50 relating to the present invention will be described.

At the time of double-sided printing, as shown in FIG. 1, after the sheet P passes through the image forming section 12 and an image is formed on the obverse thereof, the discharging rollers 32 are rotated reversely in a state of nipping the trailing end of the sheet P, and the sheet P is thereby inverted and conveyed to the re-feeding path 36. When the sheet P is introduced into the re-feeding path 36, as shown in FIG. 4B, the motor 82 is driven by an unillustrated control section, such that the supporting shaft 54*a* of the sheet feeding roller 54 is rotated, and the shaft portions 76*a* of the cams 76 are rotated in the direction of arrow A.

As shown in FIG. 7, when the supporting shaft 54*a* rotates, the first cams 60 and the second cams 64 rotate integrally therewith. Then, the rotation of the supporting shaft 54*a* is stopped when the first cams 60 abut the rollers 52*a* of the sheet feed tray 52, and the second cams 64 are at the position of abutting the frames 62. At this time, because the first cams 60 push the sheet feed tray 52 downward against the force of the spring 72, the sheets P stacked in the sheet feed tray 52 do not contact the sheet feeding roller 54. Further, because the second cams 64 push the frames 62 downward against the forces of the springs 74, the separating roller 56 is withdrawn from the position of press-contacting the sheet feeding roller 54.

Figure 4A:
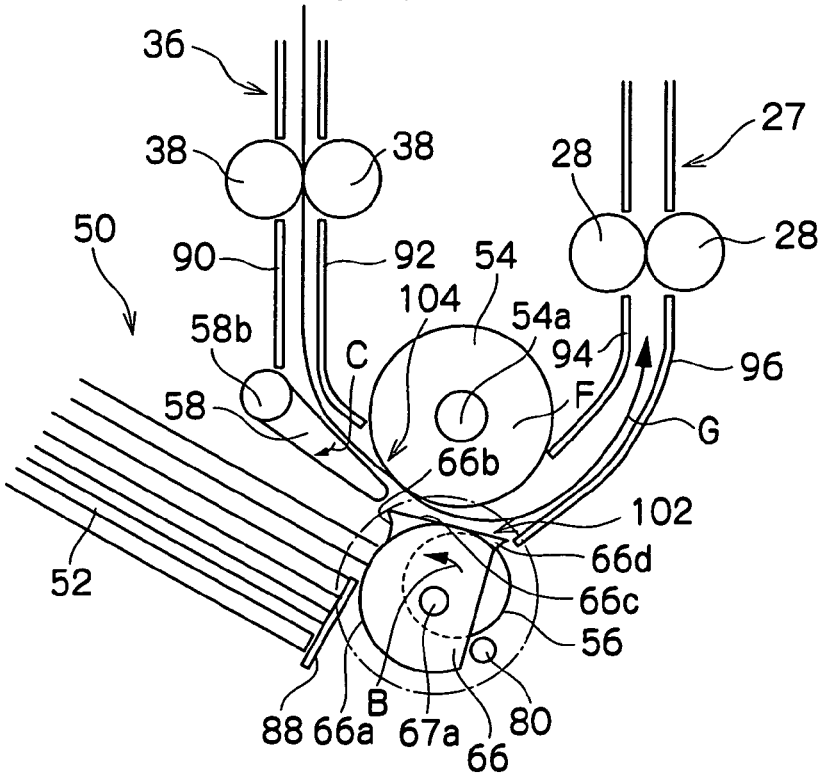
FIG. 4A is a structural diagram showing a state in which the upper guide member and the lower guide member in concert form a guide path along which a sheet is re-fed at the time of double-sided printing.
Figure 4B:
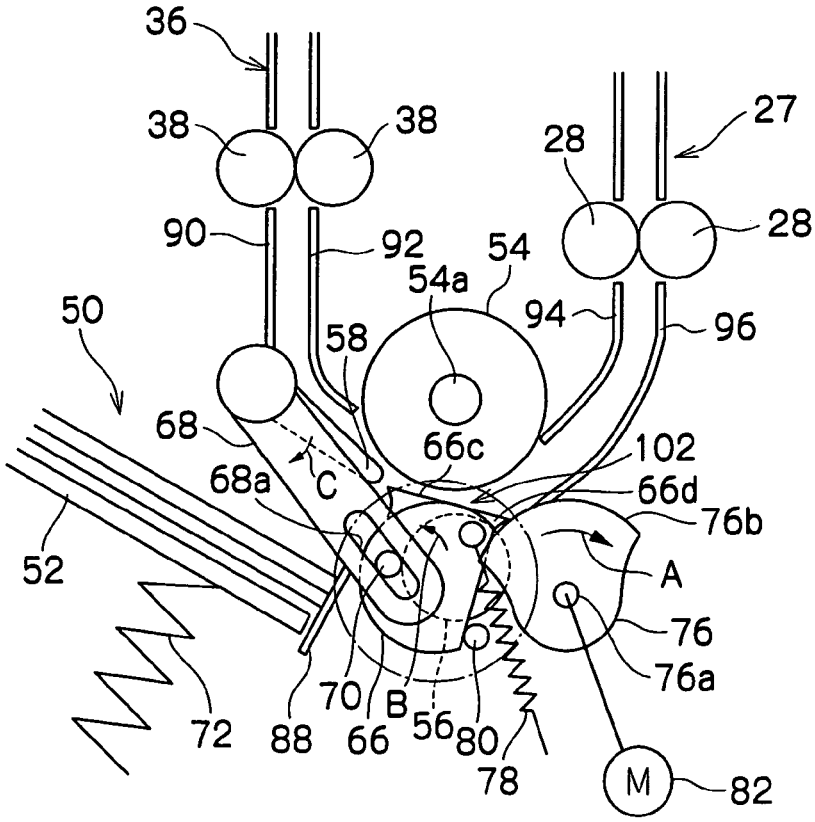
FIG. 4B is a diagram showing a state of the cam which rotates the upper guide member and the lower guide member.

As shown in FIG. 4B, when the cams 76 rotate in the direction of arrow A, due to the peripheral surface portions 76*b* of the cams 76 engaging with the protruding portions 66*d* of the lower guide members 66, the lower guide members 66 rotate in the direction of arrow B. At this time, the lower guide members 66 rotate to positions at which the guide surfaces 66*c* thereof oppose the sheet feeding roller 54 with a predetermined interval therebetween. Further, due to the engaging pieces 70 of the lower guide members 66 moving within the holes 68*a* and rotating the link members 68 in the direction of arrow C, the upper guide member 58 rotates to the guiding position 104 at which the sheet P can pass through between the upper guide member 58 and the sheet feeding roller 54. Due to the upper guide member 58 rotating in the direction of arrow C in this way interlockingly with the rotation of the lower guide members 66 in the direction of arrow B, a guide path 102, which is for the re-feeding of the sheet P, is formed between, on the one hand, the sheet feeding roller 54, and, on the other hand, the upper guide member 58 and the lower guide members 66. The sheet P, which is sent-in from the re-feeding path 36, is guided by the guide plates 90, 92 and conveyed to the guide path 102. At this time, because the separating roller 56 is withdrawn from the position of press-contacting the sheet feeding roller 54, the sheet P is guided by the upper guide member 58 and the lower guide members 66 and passes through the guide path 102. Then, the sheet P is guided by the guide plates 94, 96, is conveyed in the direction of arrow G in FIG. 4A, and is conveyed to the image forming section 12 by the conveying rollers 28 of the conveying path 27. At the image forming section 12, an image is formed on the reverse surface of the sheet P.

On the other hand, as shown in FIG. 3B, when the sheet P is to be fed from the sheet feed tray 52, the sheet feeding roller 54 is rotated in the direction of arrow F by the rotation of the supporting shaft 54*a*, and the cams 76 are rotated in the direction of arrow A by the rotation of the shaft portions 76*a*. As the supporting shaft 54*a* rotates, the abutment of the first cams 60 and the rollers 52*a*, and the abutment of the second cams 64 and the frames 62, are cancelled (refer to the state of abutment of FIG. 7). Due to the abutment of the first cams 60 and the rollers 52*a* being cancelled, the sheet feed tray 52 moves upward due to the force of the spring 72, and the top surface of the sheets P stacked in the sheet feed tray 52 is pushed against the sheet feeding roller 54. Due to the abutment of the second cams 64 and the frames 62 being cancelled, the frames 62 are pushed upward by the forces of the springs 74, and the separating roller 56 press-contacts the sheet feeding roller 54.

As shown in FIG. 3B, when the cams 76 rotate in the direction of arrow A, the engagement of the peripheral surface portions 76*b* of the cams 76 with the protruding portions 66*d* is cancelled (refer to the engaged state of FIG. 4B), and the lower guide members 66 rotate in the sheet feeding direction due to the forces of the springs 78, and abut the stoppers 80. In this way, the peripheral surface portions 66*a* of the lower guide members 66 move to positions opposing the sheet feeding roller 54. At this time, the peripheral surface portions 66*a* are positioned lower than the peripheral surface of the separating roller 56. Further, due to the engaging pieces 70 of the lower guide members 66 moving within the holes 68*a* and rotating the link members 68 in the direction of arrow D, the upper guide member 58 rotates to the withdrawn position 106 (see FIG. 3A) at which it does not project out from the sheet feeding roller 54 toward the sheet P. Due to the upper guide member 58 rotating in the direction of arrow D in this way interlockingly with the rotation of the lower guide members 66 in the sheet feeding direction, the upper guide member 58 is withdrawn to the withdrawn position 106 at which it does not interfere with the sheet P, and a sheet feeding path 100 for feeding the sheet P is formed between the lower guide members 66 and the sheet feeding roller 54.

At this time, because the sheet feed tray 52 is moved upward, the leading ends of the sheets P within the sheet feed tray 52 abut the peripheral surface portions 66*a* of the lower guide members 66, and the sheets P are guided.

In this state, due to the sheet feeding roller 54 rotating in the direction of arrow F, the uppermost sheet P stacked in the sheet feed tray 52 frictionally contacts the sheet feeding roller 54, and this uppermost sheet P is fed-out to the sheet feeding path 100. At this time, because the upper guide member 58 is withdrawn toward the sheet feeding roller 54, the sheet P does not collide with the upper guide member 58. The sheet P which is fed-out is separated by the nip portion between the sheet feeding roller 54 and the separating roller 56, such that the sheets P from the second sheet on are prevented from passing through the nip portion. The sheet P which is fed-out by the sheet feeding device 50 is conveyed to the image forming section 12 by the conveying rollers 28 disposed at the conveying path 27, as shown in FIG. 1.

Thereafter, when the sheet feeding roller 54 rotates, as shown in FIG. 7, the first cams 60 abut the rollers 52*a* and push the sheet feed tray 52 downward, and the second cams 64 abut the frames 62 and cause the separating roller 56 to withdraw from the sheet feeding roller 54. Further, as shown in FIG. 4B, due to the cams 76 rotating in the direction of arrow A and the peripheral surface portions 76*b* engaging with the protruding portions 66*d* of the lower guide members 66, the lower guide members 66 rotate in the direction of arrow B. At this time, due to the projections 66*b* of the lower guide members 66 rotating in the direction of arrow B, the sheets P abut the projections 66*b*, and are returned into the sheet feed tray 52. Further, due to the rotation of the lower guide members 66, the engaging pieces 70 move within the holes 68*a* and rotate the link members 68 in the direction of arrow C, and the upper guide member 58 rotates to the guiding position 104 at the sheet P side. Due to the upper guide member 58 rotating toward the sheet P, the top surfaces of the sheets P from the second sheet on within the sheet feed tray 52 are pressed. In this way, the sheets P from the second sheet on which are stacked within the sheet feed tray 52 are kept from pushing through between the sheet feeding roller 54 and the separating roller 56 together with the uppermost sheet P. Therefore, multiple feeding of the sheets P can be prevented, and stable feeding of the sheet P is possible.

In this way, each time the sheet feeding roller 54 rotates one time, the sheet feed tray 52 is raised and lowered, and the press-contacting and withdrawing of the separating roller 56 with respect to the sheet feeding roller 54 is repeated. The sheets P stacked in the sheet feed tray 52 are thereby sent-out one-by-one. Further, it is possible to prevent the sheets P from colliding with the sheets P which are being re-conveyed, and paper jams from occurring.

In the sheet feeding device 50, the upper guide member 58 rotates around the supporting shaft 58*b* which is at the sheet feeding direction upstream side, and the lower guide members 66 rotate. Therefore, the rotation space of the upper guide member 58 and the lower guide members 66 for switching between the guide path 102 and the sheet feeding path 100 can be made to be small, and the image forming device 10 can be made to be compact. Further, the feeding of the sheets P from the sheet feed tray 52 and the re-conveying of the sheets P from the re-feeding path 36 can be carried out in a small space while preventing paper jams.

Further, when a sheet P is fed from the sheet feed tray 52, because the upper guide member 58 is withdrawn to a position at which it does not project out from the sheet feeding roller 54 toward the sheets P, the sheet P which is being fed does not collide with the upper guide member 58.

Moreover, due to the sheet feeding roller 54 and the cams 76 being rotated by the single motor 82, there is no need to provide a driving section such as a motor or the like exclusively for rotating the upper guide member 58 and the lower guide members 66, and costs can be reduced. In addition, by interlocking the rotation of the sheet feeding roller 54 and the rotation of the upper guide member 58 and the lower guide members 66, it is possible to prevent paper jams from arising due to problems with a control device.

The projections 66*b*, which are for returning the sheets P to the sheet feed tray 52 by rotating in the direction of arrow B, are formed at the lower guide members 66. Therefore, it is easy to separate the sheet P before the sheet P advances into the press-contact portion between the sheet feeding roller 54 and the separating roller 56, and the sheet separating ability improves. It is thereby possible to even more reliably prevent the occurrence of multiple feeding. Further, because the lower guide members 66 also serve as sheet returning members, it is possible to prevent the sheet P which is being re-fed from rubbing against the remaining sheets P. In addition, because the upper guide member 58 and the lower guide members 66 are connected by the link members 68 and are rotated by the cams 76, the rotating mechanism can be prevented from becoming complex.

When the sheet P is being re-fed, the separating roller 56 is withdrawn from the position of press-contacting the sheet feeding roller 54. Therefore, at the time of re-feeding, the sheet P does not catch on the separating roller 56.

Further, as shown in FIG. 4A, after the sheet feed tray 52 moves downward, due to the lower guide members 66 rotating in the direction of arrow B, the sheets P are pushed and returned to the sheet feed tray 52 by the projections 66*b*. Namely, because the sheet feed tray 52 is withdrawn when the sheets P are returned by the projections 66*b*, the sheets do not bend back and become jammed within the conveying path without being returned to the sheet feed tray 52.

Moreover, as shown in FIG. 4A, the upper guide member 58 and the projections 66*b* approach and overlap one another when the sheets P are returned. Therefore, at the time when the sheets P are returned to the sheet feed tray 52, the upper guide member 58 keeps the leading ends of the sheets P from coming away from the projections 66*b* and riding up onto the lower guide members 66.

As shown in FIG. 3A, at the time when the sheet P is fed from the sheet feed tray 52, the sheet P is guided by the peripheral surface portions 66*a* of the lower guide members 66, and is guided to the separating roller 56. Namely, at the time of feeding the sheet P, the lower guide members 66 function as guides for guiding the sheet P to the separating roller 56.

In this way, in the sheet feeding device and the image forming device relating to the present invention, due to the upper guide member and the lower guide member rotating interlockingly, the rotational space of the upper guide member and the lower guide member, for switching between the guide path which re-feeds a sheet at the time of double-sided printing and the conveying path at the time of feeding a sheet from the sheet stacking section, can be made to be small, and compactness of the device can be realized.

Note that, the sheet feed tray 52 is disposed at the image forming device 10 illustrated in FIG. 1. However, instead, a manual sheet feed tray which can be opened and closed may be provided at the front of the lower portion of the image forming device. In this case, the sheet feeding roller 54 is structured as a manual-feed sheet feeding roller which is disposed in the direction of sending-out the sheets P which are in the manual sheet feed tray. By making the sheet feed tray 52 be a manual sheet feed tray which can open and close, the sheet feeding section at the front of the image forming device takes up less space, and the device can be made to be even more compact.

Note that, in the above-described embodiment, the sheet P which is fed from the sheet feed tray 52 is separated at the nip portion between the sheet feeding roller 54 and the separating roller 56. However, the present invention is not limited to this structure. For example, a structure may be used in which the sheet P is separated by the sheet feeding roller and a pad being pressed into contact with one another.

What is claimed is:

1. A sheet feeding device for feeding a sheet to an image forming section, the device comprising:

a sheet feeding roller which feeds sheets one-by-one;

a sheet stacking section in which a plurality of sheets can be stacked, and which pushes a sheet against the sheet feeding roller;

an upper guide member able to move between a guiding position at which, at a time of double-sided printing, the upper guide member re-feeds to the image forming section an inverted sheet which is sent-in by a sheet re-feeding section, and a withdrawn position, at which sheet feeding of the sheet stacking section is possible; and a lower guide member which is rotatable and which abuts leading ends of sheets stacked in the sheet stacking section, wherein a guide path, which guides a sheet which is re-fed at the time of double-sided printing, is formed by the upper guide member and the lower guide member rotating interlockingly via a linking member disposed on the upper guide member, wherein the rotation of the lower guide member induces rotation in the upper guide member.

2. The sheet feeding device of claim 1, wherein the upper guide member is withdrawn to the withdrawn position by rotating the upper guide member toward the sheet feeding roller.

3. The sheet feeding device of claim 1, wherein the lower guide member comprises a projection which abuts sheet-feeding-direction-leading ends of sheets and returns the sheets to positions of being stacked in the sheet stacking section.

4. The sheet feeding device of claim 3, wherein, after the sheet stacking section moves, the projection rotates and returns the sheets to the positions of being stacked in the sheet stacking section.

5. The sheet feeding device of claim 3, wherein, when returning the sheets to the positions of being stacked in the sheet stacking section, the upper guide member and the projection rotate so as to at least one of overlap one another or approach one another in a direction of returning the sheets to the positions of being stacked in the sheet stacking section.

6. The sheet feeding device of claim 1, wherein the upper guide member and the lower guide member are connected by the linking member, and at least one of the upper guide member or the lower guide member is rotated by a cam.

7. The sheet feeding device of claim 6, wherein the cam rotates interlockingly with rotation of the sheet feeding roller.

8. The sheet feeding device of claim 1, further comprising a separating member which press-contacts the sheet feeding roller and separates a sheet one-by-one when the sheet is fed from the sheet stacking section, wherein the separating member is provided so as to be able to withdraw from a position of press-contacting the sheet feeding roller.

9. The sheet feeding device of claim 8, wherein the lower guide member comprises a guide portion which guides a sheet to the separating member when the sheet is fed from the sheet stacking section.

10. An image forming device comprising:

an image forming section which forms an image on a sheet;

a sheet feeding device for feeding a sheet to the image forming section; and a sheet re-feeding section for re-feeding, to the image forming section, a sheet which is inverted after passing through the image forming section, wherein the sheet feeding device comprises:

a sheet feeding roller which feeds sheets one-by-one;

a sheet stacking section in which a plurality of sheets can be stacked, and which pushes a sheet against the sheet feeding roller;

an upper guide member able to move between a guiding position, at which the upper guide member re-feeds to the image forming section an inverted sheet which is sent-in by the sheet re-feeding section, and a withdrawn position, at which sheet feeding of the sheet stacking section is possible; and a lower guide member which is rotatable and which abuts leading ends of sheets stacked in the sheet stacking section, and a guide path, which guides a sheet which is being re-fed at a time of double-sided printing, is formed by the upper guide member and the lower guide member rotating interlockingly via a linking member disposed on the upper guide member.

11. The image forming device of claim 10, wherein the upper guide member is withdrawn to the withdrawn position by rotating the upper guide member toward the sheet feeding roller.

12. The image forming device of claim 10, wherein the lower guide member comprises a projection which abuts sheet-feeding-direction-leading ends of sheets and returns the sheets to positions of being stacked in the sheet stacking section.

13. The image forming device of claim 12, wherein, after the sheet stacking section moves, the projection rotates and returns the sheets to the positions of being stacked in the sheet stacking section.

14. The image forming device of claim 12, wherein, when returning the sheets to the positions of being stacked in the sheet stacking section, the upper guide member and the projection rotate so as to at least one of overlap one another or approach one another in a direction of returning the sheets to the positions of being stacked in the sheet stacking section.

15. The image forming device of claim 10, wherein the upper guide member and the lower guide member are connected by a link, and at least one of the upper guide member or the lower guide member is rotated by a cam.

16. The image forming device of claim 15, wherein the cam rotates interlockingly with rotation of the sheet feeding roller.

17. The image forming device of claim 10, wherein the sheet feeding device further comprises a separating member which press-contacts the sheet feeding roller and separates a sheet one-by-one when the sheet is fed from the sheet stacking section, and the separating member is provided so as to be able to withdraw from a position of press-contacting the sheet feeding roller.

18. The image forming device of claim 17, wherein the lower guide member comprises a guide portion which guides a sheet to the separating member when the sheet is fed from the sheet stacking section the sheet stacking section.

* * * * *